United States Patent [19]

Konkel

[11] 3,972,282

[45] Aug. 3, 1976

[54] TYPE TRAIN ASSEMBLY FOR PRINTING MACHINES

[75] Inventor: Joseph Konkel, Lynnfield, Mass.

[73] Assignee: Data Printer Corporation, Cambridge, Mass.

[22] Filed: Feb. 20, 1975

[21] Appl. No.: 551,108

Related U.S. Application Data

[63] Continuation of Ser. No. 402,595, Oct. 1, 1973, abandoned.

[52] U.S. Cl. ..... 101/111

[51] Int. Cl.[2] ..... B41J 1/20

[58] Field of Search ..... 101/93.13, 93.14, 111

[56] References Cited

UNITED STATES PATENTS

| | | | |
|---|---|---|---|
| 3,216,348 | 11/1965 | Oldenburg et al. | 101/111 X |
| 3,379,125 | 4/1968 | Antonucci | 101/111 X |
| 3,402,657 | 9/1968 | Potter et al. | 101/111 X |
| 3,621,778 | 11/1971 | Ripple et al. | 101/111 X |
| 3,633,501 | 1/1972 | Edwards | 101/111 |
| 3,638,565 | 2/1972 | Drejza et al. | 101/111 |
| 3,745,918 | 7/1973 | Perry et al. | 101/111 |
| 3,766,852 | 10/1973 | DePuy et al. | 101/93 |
| 3,814,012 | 6/1974 | Derc | 101/111 |

OTHER PUBLICATIONS

IBM Technical Disclosure Bulletin, Bostnick, vol. 9, No. 9, Feb. 1967, p. 1204.

IBM Technical Disclosure Bulletin, Stack, vol. 14, No. 12, May 1972, pp. 3638–3639.

IBM Technical Disclosure Bulletin, Mouchon, vol. 13, No. 8, Jan. 1971, p. 2467.

*Primary Examiner*—Edgar S. Burr
*Assistant Examiner*—Edward M. Coven
*Attorney, Agent, or Firm*—John W. Ericson

[57] ABSTRACT

A type train assembly includes a pair of parallel belts stretched around drive wheels, a series of type carriers centered between and attached to both belts to balance and divide the traction and tension forces, and a guide bar slidably engaging a groove in the rear surface of each type carrier to guide them accurately and to support them firmly for impact by print hammers. The type carriers abut one another in the direction of travel and this combines with the tension in the belts to reduce dragging of the type, which would otherwise result from stretching of the belts occasioned by hammer impact. The carriers are formed with pairs of transverse arms having flanges and projections for gripping the pair of belts, and with recesses for engaging teeth formed in the belts, to fix the carriers firmly thereon.

13 Claims, 7 Drawing Figures

TYPE TRAIN ASSEMBLY FOR PRINTING MACHINES

This application is a continuation of my copending U.S. application for Letters Pat. Ser. N. 402,595 filed by me on Oct. 1, 1973 for Type Train Assembly for Printing Machines now abandoned

BACKGROUND AND BRIEF DESCRIPTION OF THE INVENTION

The present invention is concerned with type train assemblies for high-speed printing machines now in wide use for printing information stored in computers; and is particularly directed to that type of such machines in which the type faces are mounted on carriers attached to an endless belt trained around a pair of drive wheels and passing rectilinearly through a printing station, at which hammers selectively produced impacts of printing paper and inked ribbon against the rapidly moving type faces. Machines of this nature should produce lines of print with reduced vertical misalignment, as compared with the type of machine which uses a drum having type faces spaced circumferentially around its periphery, because they use a horizontally moving type font as opposed to a vertically moving type font on a drum. Furthermore, it is much easier to change the type faces, since they are formed on slugs mounted on small individual carriers removably attached to the belt. A larger selection of characters can be made available merely by exchanging individual type slugs.

However, printing machines of the type train-and -belt kind have suffered from a relatively poor printing quality, have shown less reliability and durability, and have required more maintenance. As the print hammers strike the paper and ribbon against the type faces, they impose a retarding force that tends to drag the type and to stretch the belt, which must recover elastically between successive impacts occurring at extremely short intervals The necessarily-flexible character of the belt allows considerable freedon of movement of the type faces, both in the plane of these faces and in the direction of hammer impact. These factors combine to produce print that is usually neither very well aligned nor clear-cut. Another difficulty is that since the belt must travel at a high velocity, the mass of the carriers applies considerable centrifugal stretching force to the belt passing around the drive wheel, which subjects the belt and the carrier attachments to additional stress, and often even results in the type carriers becoming detached and flying off the belt.

It is the general object of this invention to provide an improved type train assembly and type carrier for printing machines, which produces better print quality. It is a further object to increase the durability and reduce the maintenance requirements of a type train assembly. It is another object to provide an improved type carrier which features improved means for secure attachment to a belt, and which is strong but light in weight, so that it may be made longer to carry more type faces and thereby reduce the number of carriers which must be attached to the belt to provide any required variety of type. Further objects and advantages of the invention will appear as the following description proceeds.

Briefly stated, according to a preferred embodiment thereof, I carry out my invention in part by employing a pair of parallel laterally spaced belts, to each of which is attached a series of type carriers located centrally between the belts. This balances the tractive load between the two belts, thereby not only dividing the strain produced by the drag of hammer impacts, but also resisting the tendency of the type to move irregularly and to twist in the plane of the type faces. The use of two belts also divides the belt tension, which increases their longevity.

I attach the type carriers to the belts in a mutually abutting train, which prevents the belts from stretching in the rectilinear span between the drive wheels through a printing station, and confines stretching to the relatively short curved spans around the wheels. The abutting ends of the type carriers are chamfered to avoid interference as they pass around the drive wheels. The belts are made somewhat short for the wheel spacing, and are stretched around the wheels so that they are held in tension. This tension is far greater than the drag caused by print hammer impacts, and combines with the abutting relation of the type carriers to improve the uniformity of motion of the type faces, thereby contributing to the quality of the printing.

A fixed guide bar is arranged to slide in grooves formed in rear faces of the type carriers, opposite the type faces. This firmly supports the type in the direction of hammer impact, and thereby improves the clarity of the print; furthermore, it holds the type faces in a fixed path through the printing station and prevents lateral displacement and twisting.

The individual type carriers include a central flange portion comprising a type block formed on one surface with the type faces, and a pair of laterally-entending flange portions including arms arranged on either side of the type block. The guide groove in the rear face of the carrier is defined by the rear face of the type block and between the laterally-extending flange portions. The carriers may be formed entirely of a light-weight material such as plastic, or the type block may be formed of metal and the flange portions of plastic. In the latter case, openings through the type block allow the laterally-extending flanges to be integrally molded to form a unit with the metal type block. The strength and lightness of this construction allows the carrier to be made longer than heretofore without excessive weight, so that a larger number of type faces can be formed on each carrier and the total number of carriers thereby reduced, decreasing machine cost and expediting the operation of changing or replacing type.

The laterally-extending flange portions of the carrier extend into arms which engage a toothed inner major surface of each belt, and are formed with recesses which conformably receive the belt teeth. The arms terminate in transverse flanges engaging the outer lateral edges of the belts, and in transverse projections which grip the outer major surface of each belt adjacent its outer edge. The laterally-extending flange portions also extend through a gap between the belts at which the type faces are presented, and are formed with further transverse projections which grip the outer major of each belt adjacent it inner lateral edge. The type carriers are thus held securely on the belts.

DESCIPTION OF THE DRAWINGS

While the specification concludes with claims particularly pointing out the subject matter which I regard as my invention, it is believed that a clearer understanding may be gained from the following detailed description of a preferred embodiment thereof, referring to the accompanying drawings, in which:

Figure 1:
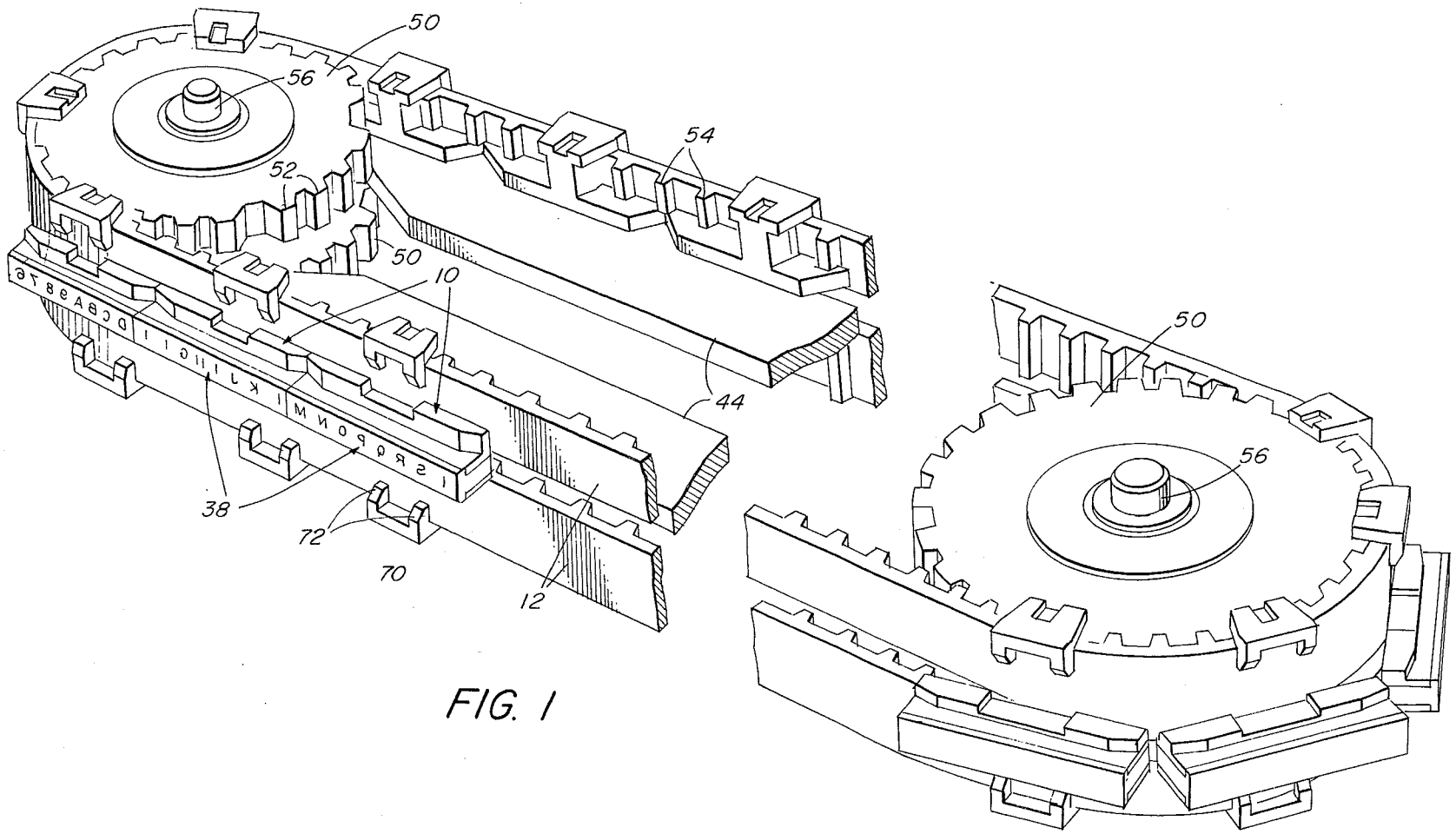
FIG. 1 is a fragmentary schematic view in perspective of the improved type train assembly.

Referring to the drawings, the preferred embodiment of the invention includes a pair of endless belts 12 of flexible elastomeric material, which are preferably reinforced with plastic webs or the like in a conventional fashion. The belts are formed with equally-spaced teeth 54, and are trained around two pairs of drive wheels 50 having interfitting teeth 52. The belts are made somewhat short for the spacing between the wheels, and are stretched over the wheels under tension. At least one of the wheels 50 is driven by suitable motive means (not shown) through one of the parllel shafts 56, both sets of wheels being bring rotatable on axes defined by the shafts 56. The belts are thus extended through parallel laterally spaced paths, which include rectilinear spans between the wheels; either of these straight spans may be used as a printing station.

Figure 2:
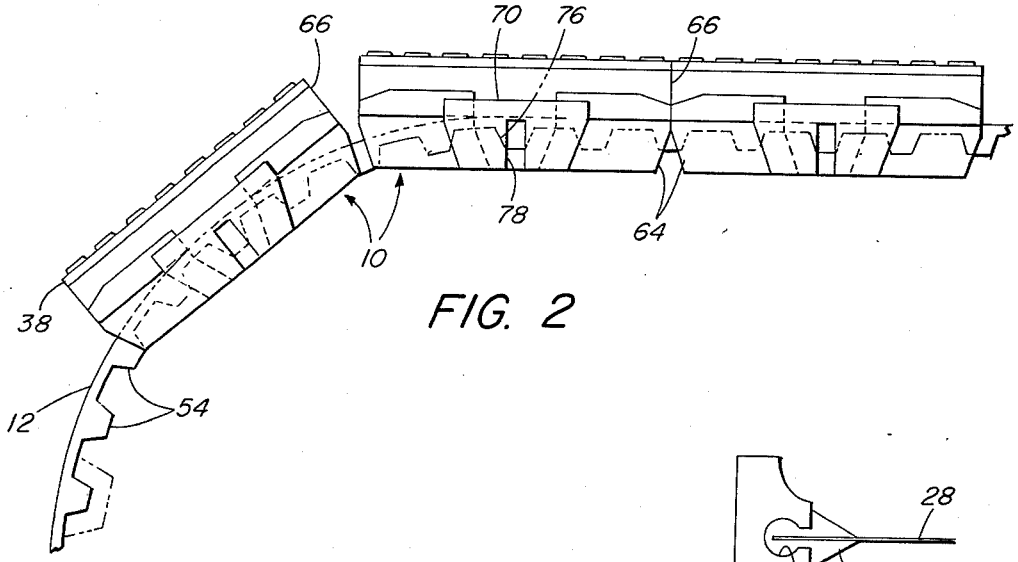
FIG. 2 is a fragmentary plan view in side elevation of the assembly of FIG. 1.

A train of type carriers 10 is attached in a train to each of the belts 12, with adjacent carriers abutting one another at end faces 66 normal to type faces 39 thereof. Any desired font of type characters is formed on the faces 39 of the carriers, as illustrated. Each end face of the carriers is chamfered at 64, adjacent to a rear surface opposite the type face 39, to avoid interference between adjacent carriers as they pass around the wheels 50; this is best shown in FIG. 2.

FIG'S. 4–6 best illustrate one construction of the individual type carriers 10. Each carrier includes a metal type block 38, which comprises a central flange portion of the carrier, and has a T-shaped cross-section formed by side channels 37. The carrier also includes a pair of laterally extending flange portions 62, which include arms 68 extending transversely of the belts 12 and laterally of the type block 38 in opposite directions. These arms are formed with recesses 76, each of which conformably receives a tooth 54 of a corresponding belt, while the arms engage the inner major surfaces of the belts. Each arm 68 terminates in a transverse flange 70 engaging an outer edge of the corresponding belt, and the flanges 70 in turn terminate in pairs of spaced transverse projections or teeth 72, which engage the outer major surfaces of the belts adjacent to their outer edges. Each flange 70 is formed with a slot 78 for receiving a metal slug (not shown) for the purpose of electrical identification of the locations of the various type faces 39, as is well understood in the art. The flange portions 62 are formed with further pairs of spaced transverse projections or teeth 74, which are opposed to the projections 72 to engage the outer major surfaces of the belts adjacent to their inner edges. The carriers 10 are securely attached to both belts 12 by cooperation of the flange portions 62, arms 68, recesses 76, flanges 70, and projections 72 and 74.

Figure 5:
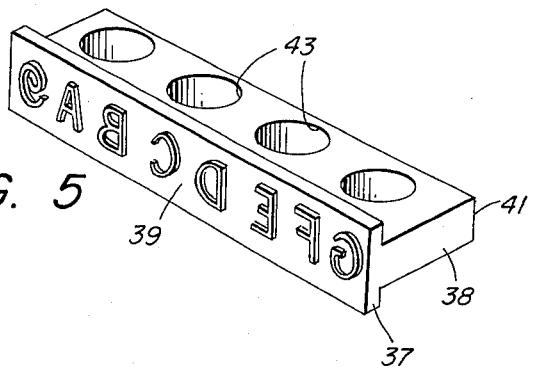
FIG. 5 is a view in perspective of a type block comprising one of theelements of the type carrier of Fig. 4.
Figure 4:
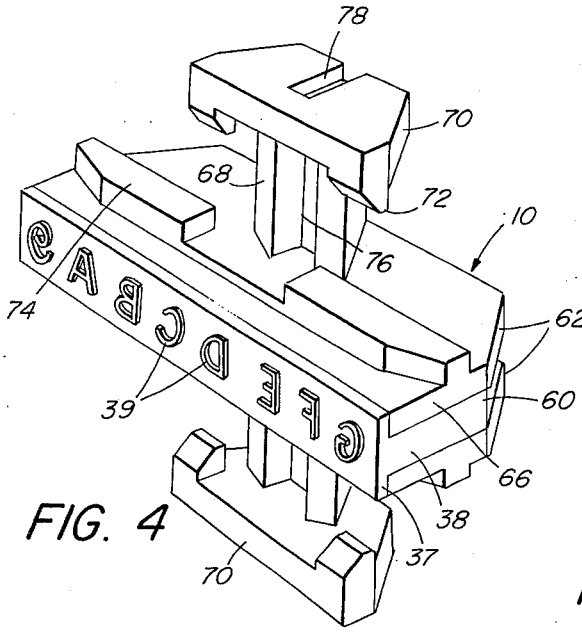
FIG. 4 is a front view in perspective of one of the type carriers of the assembly.

As shown in Fig. 5, each type block 38 has one or more openings 43 extending therethrough. The laterally extending flange portions 62 are integrally molded of plastic or other light-weight material, and are joined by this material extending through the openings 43. By this expedient, the type carrier is formed as a strong but light integral unit.

A rectilinear guide groove 60 is defined in the rear face of the type carrier 10 between the parllel laterally-extending flange portions 62, and a planar rear surface 41 of the metal type block 38. As shown in FIG'S. 1 and 3, a pair of carrier guide bars 44 are slidably engaged in the grooves 60 of the type carriers 10 as they pass through the rectilinear spans between the drive wheels 50.

Figure 3:
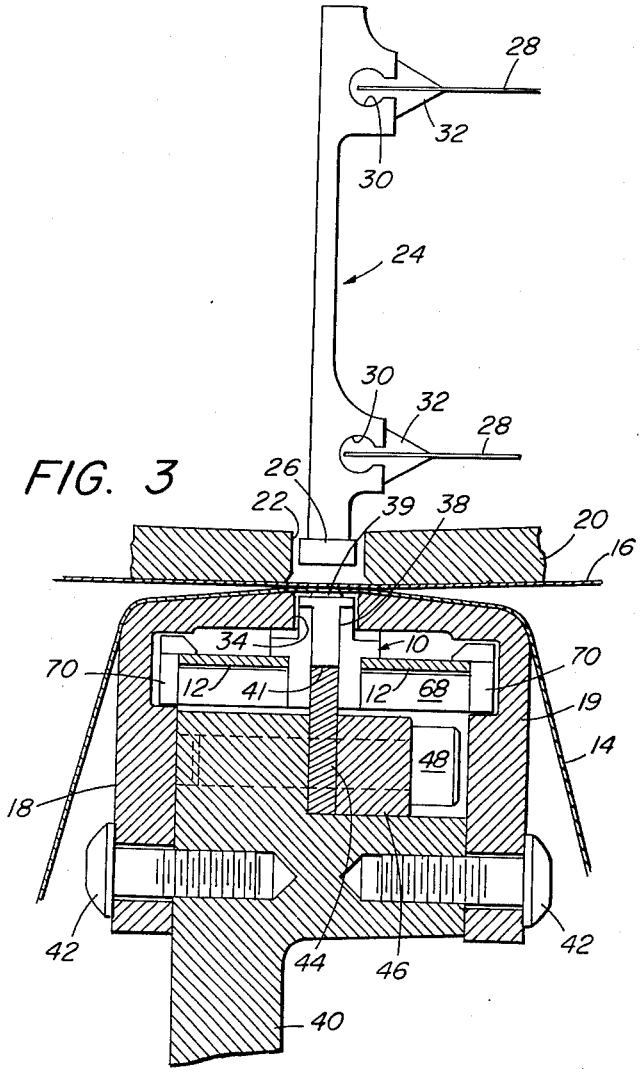
FIG. 3 is a fragmentary sectional view in side elevation of a portion of the type train assembly, shown combined with related elements of a printing machine.

An application of the improved type train assembly to a typical printing machine is shown in FIG. 3. The belts 12 carry the train of carriers 10 through a printing station, located along one of the straight spans of the belts, in confronting juxtaposition of the type faces 39 to the heads 26 of a series of print hammers 24 arranged side-by-side along the length of the belts. A sheet 16 of printing paper and an inked printing ribbon 14 are passed between the hammers and the type faces, the former passing over a guide 20 having a slot 22 for the hammers, and the latter over a guide 19 having a slot 34 for the type blocks 38. The hammers 24 are supported in a conventional manner by a pair of parallel spring leaves 28, attached for convenient replacement by fillets 32 in mounting sockets 30 formed in the hammers, for reciprocation by conventional actuators (not shown) to impact the paper and ribbon against selected type faces.

The guide 19 is mounted on a support 40 by means of screws 42. The carrier guide bar 44 is mounted on the support 40 by means of a gib 46 and screws 48, so that it backs up and slidably abuts the rear faces 41 of the type blocks 38 as they pass through the printing station. The type faces 39 are thus given a rigid support so that they can produce print of maximum clarity when struck by the hammers 24. The tendency of the hammer impacts to drag the type faces is resisted both by the tension in the belts 12 and the mutual abutment of the carriers 10, which resist stretching of the belts between the carriers, and contribute further to print clarity.

Figure 7:
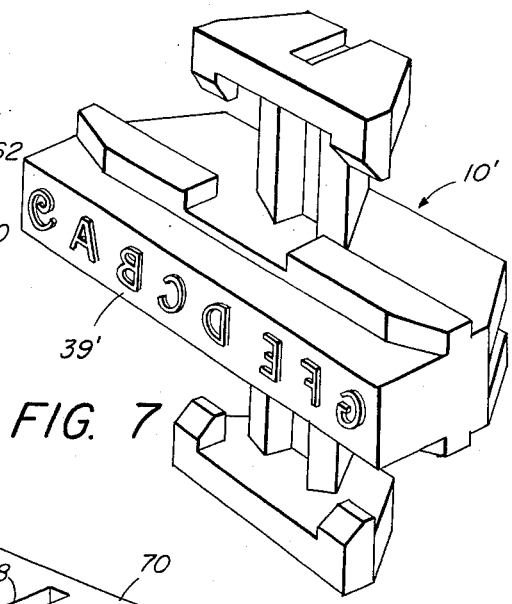
FIG. 7 is a front view in perspective of a modified type carrier.
Figure 6:
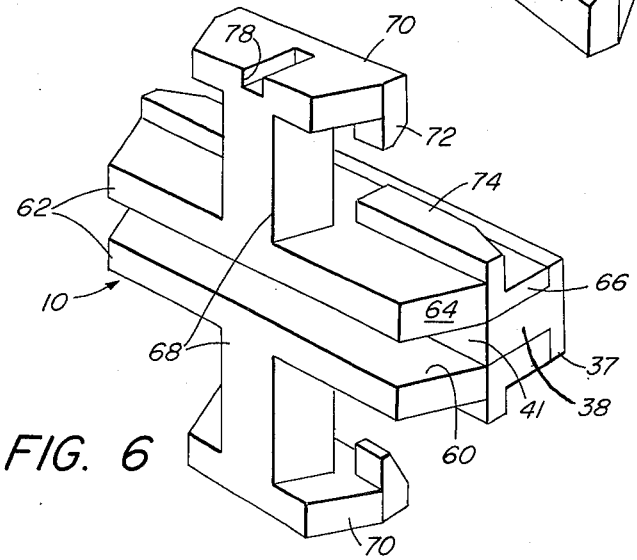
FIG. 6 is a rear view in perspective of the type carrier of Fig. 4.

An alternative construction of the type carriers is shown at 10′ in FIG. 7, in which the type faces 39′ are formed integrally in the carrier and are of the same material, which may be plastic, rather than being formed on a separate metal type block. The carrier can then be molded as a unit with the type faces. The form of the carrier is otherwise identical with that shown in the preceding figures.

What I claim is:

1. A type train assembly for a printing machine, comprising, in combination:

a plurality of drive wheel means rotatably mounted on spaced-apart axes;

a pair of endless belts having opposed inner and outer edges trained around said drive wheel means and extending in spaced parallel relationship with said edges parallel about a path which includes a rectilinear portion defining a printing station;

a plurality of type carriers centered between and each attached to both of said belts, said type carriers abutting the inner edges of said belts and comprising arms extending across said belts to portions engaging said outer edges and thereby holding said belts against movement in any direction from said spaced parallel relationship; said type carriers being located along said belts in a train and abutting against adjacent type carriers in said rectilinear portion of the path of said belts, said type carriers bearing type faces on first commonly directed faces thereof, and being formed each with a guide groove of substantially U-shaped cross-section in second faces thereof directed oppositely to said first faces, said guide grooves being between said belts and aligned with said rectilinear path when said type carriers are in said rectilinear portion; and a stationary guide bar extending between said belts along said rectilinear portion and slidably and conformably engaging said guide grooves of said type carriers passing through said rectilinear portion of the path of said belts.

2. A type train assembly as recited in claim 1, said belts being formed of elastomeric material and being shorter when relaxed than the span between said wheel means, and being trained around said wheel means under tension.

3. A type train assembly as recited in claim 1, said belts and said wheel means being formed with teeth, said type carriers being formed with recesses receiving a first group of the teeth of said belts to positively locate said carriers lengthwise of said belts, a first group of teeth of said wheel means being formed to engage said type carriers, and a second group of the teeth of said wheel means being formed to engage a second group of the teeth of said belts said second groups being intercalated with said first groups.

4. A type train assembly as recited in claim 1, in which said belts comprise first and second spaced major surfaces normal to said edges, and in which said arms extend transversely of said belts, each engaging said first major surface of a different one of said belts, siad arms terminating in transverse flanges each extending along and engaging one of said outer edges of a different one of said belts, sai transverse flanges each terminating in at least one transverse projection engaging said second major surface of the corresponding belt to locate said type faces in a fixed position with respect to said belts.

5. A type train assembly as recited in claim 4, said belts and said wheel means being formed with interfitting equally spaced teeth, said arms of said type carriers each being formed with a recess conformably receiving a tooth of the corresponding belt to positively locate said carriers lengthwise of said belts.

6. A type train assembly as recited in claim 4, said type carriers each being formed with a central flange portion extending between said belts and bearing said type faces on a surface thereof protruding between said belts, each of said transverse flanges being formed with a plurality of said transverse projections engaging said second major surface of the corresponding belt.

7. A type train assembly as recited in claim 4, said type carriers each being formed with a central flange portion extending between said belts and bearing said type faces on a surface thereof protruding between said belts, each of said central flange portions being formed with at least two transverse projections, one engaging said second major surface of each of said belts.

8. A type train assembly as recited in claim 4, said transverse flanges each terminating in a plurality of said transverse projections spaced apart longitudinally of the corresponding belt and engaging said second major surface thereof.

9. A type train assembly as recited in claim 1, in which each of said type carriers comprises a type block and a pair of flange portions extending therefrom normal to the plane of said type faces, said guide grooves being defined by said flange portions and by surfaces of said type blocks lying between said flange portions.

10. A type train assembly as recited in claim 1, the mutually abutting ends of said type carriers being chamfered on portions adjacent to said second faces thereof to prevent interference between adjacent type carriers as they pass with said belts about said drive wheel means.

11. A type train assembly for a printing machine, comprising, in combination, a plurality of drive wheel means rotatably mounted on spaced-apart axes; a first endless belt trained around said drive wheel means and extending about a first path; a second endless belt trained around said drive wheel means and extending about a second path parallel to and laterally spaced from said first path; said belts having inner and outer parallel edges, said paths including parallel rectilinear portions defining a printing station; a plurality of type carriers; said type carriers having arms engaging said outer edges of said belts to prevent outward movement of said belts from said lateral spacing; said type carriers being located along said belts in a train; said type carriers bearing type faces on first commonly directed faces thereof, and being formed each with a portion extending between said belts abutting said inner edges of said belts to prevent inward movement of said belts from said lateral spacing and formed with a guide groove of substantially U-shaped cross section in second faces of said type carriers directed oppositely to said first faces, said guide grooves being between and parallel to said paths; and a stationary guide bar between said belts and slidably and conformably engaging said guide grooves of said type carriers between said belts in said printing station.

12. The apparatus of claim 11, in which said type carriers each comprise a type block and a pair of flange portions extending therefrom normal to the plane of said type faces, said guide groove being defined by said flange portions and by a surface of said type block lying between said flange portions.

13. A type train assembly as recited in claim 11, said belts and said wheel means being formed with teeth, said type carriers being formed with recesses receiving a first group of the teeth of said belts to positively locate said carriers lengthwise of said belts, a first group of the teeth of said wheel means being formed to engage said type carriers, and a second group of the teeth of said wheel means being formed to engage a second group of the teeth of said belts, said second groups being intercalated with said first groups.

* * * * *